United States Patent [19]

Contardi

[11] 4,098,038

[45] Jul. 4, 1978

[54] TILED ENCLOSURE, AND METHOD TO MAKE SAME

[76] Inventor: John G. Contardi, 3612 Parker, Dearborn, Mich. 48121

[21] Appl. No.: 752,532

[22] Filed: Dec. 20, 1976

[51] Int. Cl.[2] ..... A47B 5/00

[52] U.S. Cl. ..... 52/35; 52/389

[58] Field of Search ..... 52/34, 35, 384, 385, 52/79.1, 388, 389; 4/146

[56] References Cited

U.S. PATENT DOCUMENTS

| | | | |
|---|---|---|---|
| 2,993,212 | 7/1961 | Ruhm | 4/146 |
| 3,646,180 | 2/1972 | Winnick | 52/388 X |
| 3,817,012 | 6/1974 | Wack et al. | 52/35 X |
| 3,992,825 | 11/1976 | May | 52/35 |

*Primary Examiner*—Ernest R. Purser
*Assistant Examiner*—Carl D. Friedman
*Attorney, Agent, or Firm*—Allan J. Murray

[57] ABSTRACT

A pre-formed structure, such as a shower stall, having three walls, each wall is comprised of a plurality of sheets of multiple, conjoined tile, having opposite finished and unfinished faces; binding materials such as adhesive, heating duct tape applied to the unfinished surfaces to conjoin the edges of the sheets of tile, and such materials similarly being applied to conjoin adjacent longitudinal edges of the walls; horizontal support members, composed of flexible material extending about the walls to interengage the sheets of tile and support them in position; vertical, rigid reinforcing elements extended upon each wall to help impart rigidity to the completed structure; a floor, or pan, preferably dimensioned to interengage with and be connected to the bottom marginal edge portions of said walls, and an upper wall preferably dimensioned to engage with and be connected to the upper marginal edge portions of said three walls. A viscous, quick-drying material to impart rigidity and unity to the structure is applied to the unfinished surface of the tiles, to cover the binding members, supporting elements, and reinforcing members.

5 Claims, 6 Drawing Figures

TILED ENCLOSURE, AND METHOD TO MAKE SAME

BACKGROUND OF INVENTION

This invention is in the field of pre-fabricated, water-resistant structures for use in buildings, and particularly for use as shower stalls, or bathtubs. Preliminary research disclosed to the inventor no pre-fabricated structure utilizing all of the features in the relationship disclosed hereinafter. Nor does the prior art provide either the structure or the method utilized by applicant for the quick, permanent, and economical construction of pre-fabricated units.

SUMMARY OF INVENTION

Invention lies in the construction of a structure having a plurality of sidewalls, constituted of sheets of multiple, conjoined tiles having the edges of said sheets themselves conjoined by application of an adhesive tape such as the duct tape, commonly applied to heating ducts, which tape is very powerfully adhesive.

Invention further lies in use of this tape to conjoin the edges of the walls, and in the use of bands, as support members as will be hereinafter disclosed, to secure successive rows of sheets of multiple, conjoined tile in position, until all of the required sheets of tile have been applied so that the adhesive tape may then be applied.

Invention further resides in the use of rigid, vertical reinforcing members to help impart rigidity and unity to the completed structure.

Figure 1:
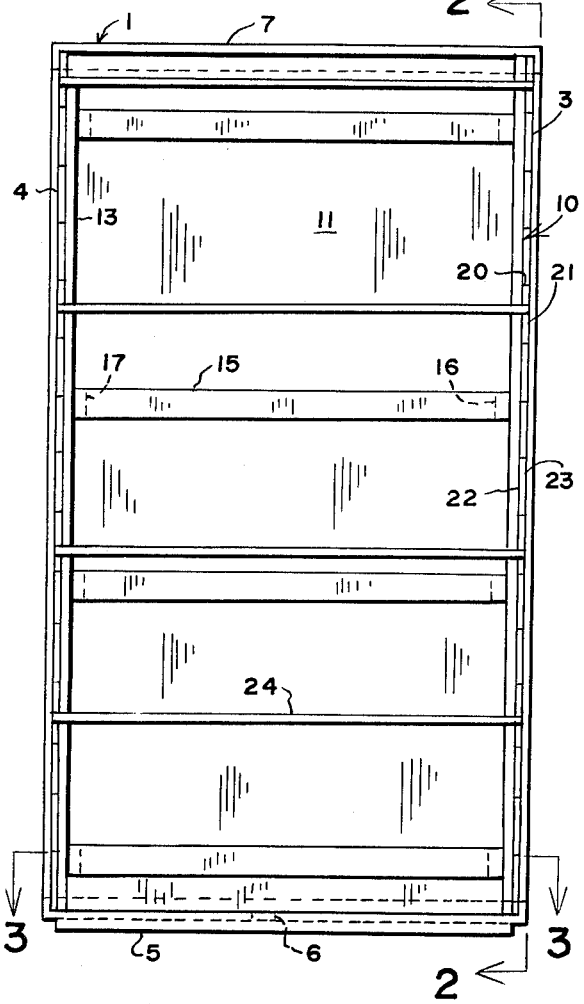
FIG. 1 is a front elevational view on line 1—1 of FIG. 2, showing the close-fitting relationship of the form and the structure which is assembled thereon.

In these views the reference character 1 designates the water resistant structure generally, and the drawings show this structure in the form of a shower stall. The structure includes a main wall 2, having substantially parallel, vertical, longitudinal edges. A first such edge is abutted by a longitudinal edge of a first sidewall 3, and the second such edge of the main wall 2 is abutted by the longitudinal edge portion of a second sidewall 4. The lower, marginal edge portions of the sidewalls are received and retained in the marginal edge portions of a bottom wall or pan 5. The pan is provided with a drain hole 6. It may be desirable to dish the bottom pan downwardly centrally, to facilitate draining water through the drain hole, although the bottom wall of said pan in 5 is shown simply as a flat surface. The pan 5 may also be elevated on legs either added to or formed integrally with said pan.

The reference character 10 designates generally a form upon which the various components of the water resistant structure, or shower stall, are assembled. The form has a main wall 11, and a first and second sidewall, 12 and 13. To impart rigidity to the form, rear braces 14 are interconnected with front braces 15, by means of side braces 16 and 17. The braces are secured to the interior of the form, as by nails, screws, or the like (not shown).

ASSEMBLY OF THE STRUCTURE

Figure 2:
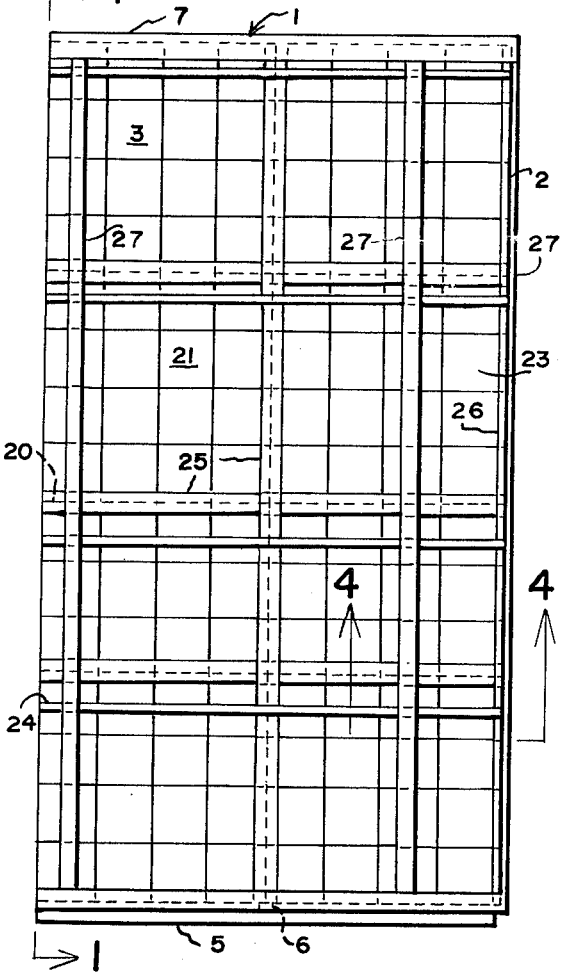
FIG. 2 is a side elevational view taken on line 2—2 of FIG. 1 showing the tiles comprising the wall, and the further elements contributing to the rigidity and unity of this structure.
Figure 3:
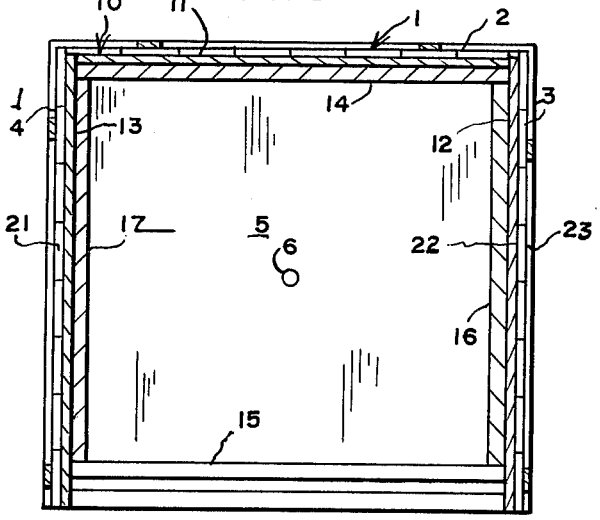
FIG. 3 is a horizontal, sectional view taken on line 3—3 of FIG. 1.
Figure 4:
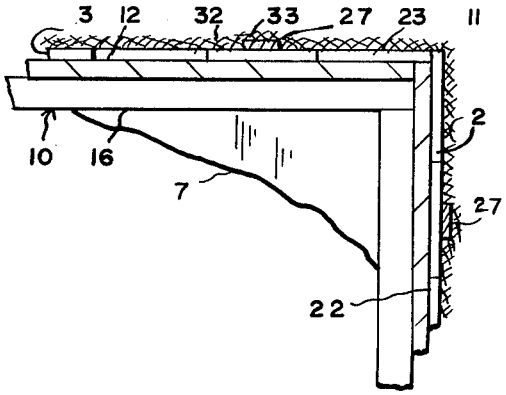
FIG. 4 is a horizontal, sectional view on a larger scale, taken on line 4—4 of FIG. 2, but showing only a portion of the wall structure and form.
Figure 5:
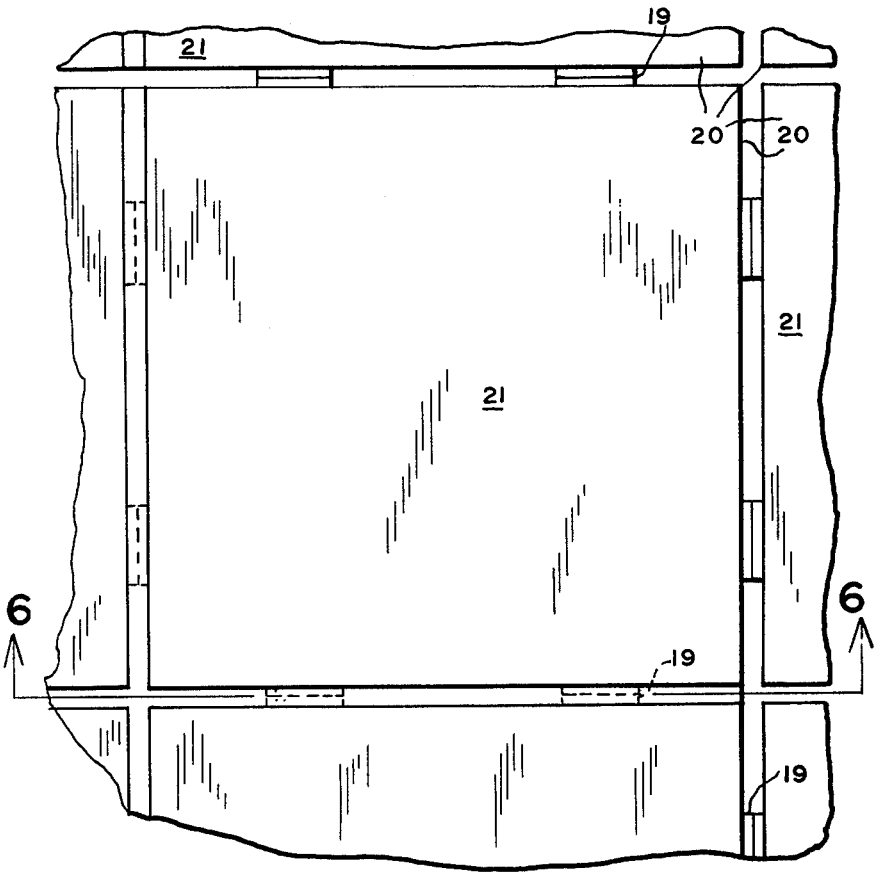
FIG. 5 is a partial, sectional view similar to FIG. 2, but on a much larger scale, showing lugs along the periphery of the sheets of conjoined tile, among which lugs serve to space such sheets of conjoining tile from each other.
Figure 6:
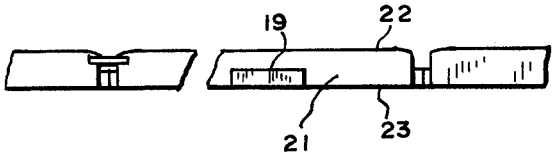
FIG. 6 is a sectional, partial view taken on line 6—6, FIG. 5.

As seen in FIG. 2, sheets 20 of multiple, conjoined tiles are utilized. Each tile is joined to adjacent tiles by a flexible web of rubber, or plastic, extending the full length of the edge of each said tile. For illustrative purposes the sheets of tile are shown as having sixteen individual tiles 21, each joined to the other. FIG. 5 shows that each of the four peripheral edge surfaces of each tile is formed with a protuberance or lug 19, which in effect spaces each tile approximately 1/16 of an inch from the adjacent tile to which the webbing material, which simulates grout, attached it. Therefore, with the individual tiles aligned, each sheet of sixteen tiles will be peripherally spaced by about 1/16 of an inch from the adjacent sheet of tile. Once the structure is assembled, as hereinafter described, this spacing will afford the application of grout to render the final structure fully water resistant, and to give uniformity of appearance to the over all structure.

The tiles are formed with a finished, or a glazed side, 22, and a rough, unfinished, or unglazed side 23. The finished or glazed side, will form the interior of the shower stall and is placed toward the form 10. It is proposed that in employing the form in a vertical position, the necessary number of sheets of tile will be placed in a bottom row, or course, and banded by support horizontally elongated, vertically spaced strips or bands 24, to resist dislodgment of the sheets of tile during the subsequent steps of assembly of the device.

When the uppermost row or course of sheets 20 of tile have been applied, and secured in position by banding, then strips 25 of a powerfully adhesive tape such as duct tape (used in the assembly of ducts for the conduct of hot and cold air) are employed to conjoin the adjacent, marginal edge portions of the sheets of tile, both vertically and horizontally. Further strips 26 of this adhesive tape are applied at the rearmost corners of the proposed structure to secure the corners together.

Vertically elongated, horizontally spaced and substantially rigid reinforcing elements 27, as of wood, or the like, are then placed in position as may be seen in the drawings, and are secured in such position by the dabs of glue (not shown). It is noted that the supporting bands 24 extend completely around the structure, and across the opening between the two walls 12 and 13. This span 24 will be removed as by cutting after the structure has been completed.

With the sheets 20 of tile in position, and secured by supporting bands 24, adhesive tape 25, and reinformed by the elements 27, a coating 32 of resin in viscuous form is applied. This can be done by either brush or spray, and it is also desired that this coating be reinforced by the inclusion therein of fiberglass shreds or strips 33.

The fiberglass shreds and strips may be applied to a coating of resin, or may be incorporated in the coating as it is applied by conventional spray devices which are available on the market.

Once the coating of resin and fiberglass has been allowed to cure, the spans 24a of the supporting band are cut and removed, and the form 10 is removed.

What I claim is:

1. A pre-formed, water resistant structure including, a substantially vertical, elongated main wall having a first, vertical longitudinal edge, a first sidewall elongated approximately coextensively with said main wall and having a longitudinal edge adjacent to said first longitudinal edge, each said wall including peripherally adjacent sheets of multiple, conjoined tiles, and each wall having an inner surface and an outer surface, adhesive binding means conjoining the adjacent peripheries of said sheets of tile to constitute each respective wall, further binding means conjoining said adjacent longitudinal edge portions, a plurality of horizontally elongated, vertically spaced support members applied to said outer surfaces and continuously interengaging said walls, and a coating of material covering and adhering to said outer surfaces, said coating covering said support members, and being solidified to give rigidity and unit to said structure.

2. A pre-formed structure as set forth in claim 1, further including, a plurality of vertically, elongated, horizontally spaced, rigid reinforcing elements applied to the outer surface of each respective wall, and interengaging the sheets of multiple, conjoined tiles constituting each respective wall, said reinforcing elements being covered by said coating.

3. In a pre-formed structure as set forth in claim 2, said main wall having a second longitudinal edge, a second sidewall comprised of peripherally adjacent sheets of multiple, conjoined tiles, and having an inner surface and an outer surface, said second sidewall having a longitudinal edge adjacent to said second longitudinal edge of said main wall, adhesive binding means conjoining the adjacent peripheries of said sheets of tile on said second sidewall, adhesive binding means conjoining said last mentioned longitudinal edges, to conjoin said second sidewall with said main wall, said support members extending to interengage said second sidewall with said main wall, reinforcing elements applied to the outer surface of said second sidewall, and interengaging said sheets of multiple, conjoined tiles and said coating being applied to the outer surface of said second sidewall whereby said coating extends contiguously about the outer surfaces of the main wall, the first sidewall and the second sidewall.

4. In a pre-formed structure as set forth in claim 3, a bottom wall, having three respective marginal side portions adapted to engage the respective bottom, marginal, edge portions of said main wall, first sidewall and second sidewall, said coating covering the engaged marginal portions to maintain said interengagement.

5. In a pre-formed structure as set forth in claim 4, a top wall, said top wall having respective marginal edge portions adapted to engage respective, upper, terminal, marginal edge portions of said main wall, first sidewall and second sidewall, said coating covering said marginal portions, to maintain said engagement.

* * * * *

UNITED STATES PATENT AND TRADEMARK OFFICE

CERTIFICATE OF CORRECTION

PATENT NO. : 4,098,038

DATED : July 4, 1978

INVENTOR(S) : John G. Contardi

It is certified that error appears in the above–identified patent and that said Letters Patent are hereby corrected as shown below:

Column 2, line 22, delete "attached" and insert --attaches-- therefor;

Signed and Sealed this

Sixth Day of February 1979

[SEAL]

*Attest:*

RUTH C. MASON
*Attesting Officer*

DONALD W. BANNER
*Commissioner of Patents and Trademarks*